US007876057B2

(12) United States Patent
Tatsumi

(10) Patent No.: US 7,876,057 B2
(45) Date of Patent: Jan. 25, 2011

(54) IMAGE DISPLAY APPARATUS

(75) Inventor: Eisaku Tatsumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 895 days.

(21) Appl. No.: 11/762,102

(22) Filed: Jun. 13, 2007

(65) Prior Publication Data

US 2008/0007183 A1 Jan. 10, 2008

(30) Foreign Application Priority Data

Jul. 5, 2006 (JP) ..... 2006-185524

(51) Int. Cl.
*G05F 1/00* (2006.01)

(52) U.S. Cl. ..... 315/291; 315/169.1; 315/169.3; 315/337; 315/360; 345/100; 345/84; 345/90; 345/211

(58) Field of Classification Search ... 315/169.1–169.3, 315/291, 300, 323, 337, 360; 345/74.1, 76, 345/77, 84, 87, 90, 100, 102, 211, 212; 313/309, 313/496, 497; 445/24
See application file for complete search history.

(56) References Cited

U.S. PATENT DOCUMENTS 6,506,087 B1 * 1/2003 Fushimi et al. ..... 445/24
6,802,753 B1 * 10/2004 Ando et al. ..... 445/6
6,809,480 B2 * 10/2004 Shino ..... 315/169.1
6,879,096 B1 * 4/2005 Miyazaki et al. ..... 313/495
7,067,171 B1 * 6/2006 Ito ..... 427/77

FOREIGN PATENT DOCUMENTS

JP 2000-089718 3/2000
JP 2000-214819 4/2000

* cited by examiner

*Primary Examiner*—Haissa Philogene
(74) *Attorney, Agent, or Firm*—Fitzpatrick, Cella, Harper & Scinto

(57) ABSTRACT

To provide an image display apparatus having: an electron source; a light-emitting member for emitting a light by irradiation with electrons emitted from the electron source; an anode electrode, which is arranged being opposed to the electron source; a high-voltage generating circuit for generating a potential which rises in a predetermined period; a wiring for connecting the anode electrode to the high-voltage generating circuit; a comparator; a first circuit for applying a first potential satisfying a positive correlation with the potential on the wiring to the comparator; and a second circuit for applying a second potential, which continuously rises or rises in stepwise manner in the predetermined period, to the comparator. The comparator outputs a result of comparison between the first potential and the second potential.

18 Claims, 17 Drawing Sheets

IMAGE DISPLAY APPARATUS

BACKGROUND OF THE INVENTION

1. Field of the Invention

The present invention relates to an image display apparatus provided with an electron-emitting device.

2. Description of the Related Art

Conventionally as an electron-emitting device, two kinds, namely, a hot cathode device and a cold cathode device have been known. Among them, as the cold cathode device, for example, a surface conduction electron-emitting device, a field emission type electron-emitting device (an FE type), and a metal-insulator-metal type electron-emitting device (an MIM type) or the like have been known.

Particularly, as application to the image display apparatus, an image display apparatus using combination of a surface conduction electron-emitting device and a phosphor emitting a light by irradiation of an electron beam has been studied. The image display apparatus using combination of the surface conduction electron-emitting device and the phosphor has been expected to have a property more excellent than that of the image display apparatus of another conventional system. For example, as compared to a liquid crystal display apparatus, which has been widely used in recent years, it can be said that this image display apparatus is more excellent because this image display apparatus is self-luminous type, and a backlight is not needed, and a viewing angle is wide.

SUMMARY OF THE INVENTION

The present applicant has tried to manufacture cold cathode devices made of various materials, with various manufacturing methods, and of various constitutions. Further, the present applicant has studied a multi electron beam source having many cold cathode devices aligned and an image display apparatus, to which this multi electron beam source is applied, has been studied.

Inside of a container, in which the cold cathode devices are aligned, a high voltage of about several kV to several tens kV is applied between a substrate and an anode electrode. Accordingly, a discharge tends to take place very easily because the container is in a reduced-pressure atmosphere and the container is applied with the high voltage. Therefore, a current due to an unexpected discharge flows only occasionally between the anode electrode and an electron source or the like. Here, the discharge means that insulation is lost in a vacuum space under a high voltage and current flows between the both electrodes. In other words, the discharge according to the present invention is different from a phenomenon such that electrons are discharged from an electron source toward an anode electrode on the basis of a video signal.

If this current due to the discharge is generated frequently, the cold cathode device and the electrode may have been damaged.

A cause of the discharge is not clearly known. Possible causes are deterioration of a degree of vacuum, charge-up of an insulation layer of a device substrate, and a projection and a burr, which are generated by mistake upon manufacture of the device substrate and a fluorescent plate, for example.

In Japanese Patent Application Laid-Open No. 2000-89718, a method for detecting discharge by monitoring change of a current flowing through an anode is disclosed. As another method, a method for detecting discharge by providing many conductive patterns which are completely insulated from a cold cathode device and the wiring thereof on a substrate and monitoring change of a potential of the conductive pattern using a voltage measurement system with very high input impedance is disclosed.

In Japanese Patent Application Laid-Open No. 2000-214819, a method for preventing arc discharge or reducing the scale of the arc discharge by monitoring change of a potential of the anode is disclosed. Specifically, the constitution for rapidly lowering a potential difference between the anode and the cathode by measuring the potential of the anode using an electrometer which is provided in adjacent to the anode substrate and shorting the anode and the cathode when its potential change exceeds a threshold value is disclosed.

The conventional detection method which is disclosed in Japanese Patent Application Laid-Open No. 2000-214819 serves to detect if variation of an anode potential in a static state is abnormal or not.

However, the present inventor found that discharge may take place even during a period till the anode potential attains to the static state and the anode potential can be varied abnormally.

Therefore, an object of the present invention is to provide an image display apparatus which can appropriately detect abnormal variation of the anode potential generated in the display apparatus due to discharge or the like even during a period when a high voltage output is varied, upon starting-up of the display apparatus, for example.

A first aspect of the present invention provides an image display apparatus comprising: an electron source; a light-emitting member for emitting a light by irradiation with electrons emitted from the electron source; an anode electrode, which is arranged being opposed to the electron source; a high-voltage generating circuit for generating a potential which rises in a predetermined period; a wiring for connecting the anode electrode to the high-voltage generating circuit; a comparator; a first circuit for applying a first potential satisfying a positive correlation with the potential on the wiring to the comparator; and a second circuit for applying a second potential, which continuously rises or rises in stepwise manner in the predetermined period, to the comparator; wherein the comparator outputs a result of comparison between the first potential and the second potential.

A second aspect of the present invention provides an image display apparatus comprising: an electron source; a light-emitting member for emitting a light by irradiation with electrons emitted from the electron source; an anode electrode, which is arranged being opposed to the electron source; a high-voltage generating circuit for generating a potential which rises in a predetermined period; a wiring for connecting the anode electrode to the high-voltage generating circuit; a comparator; a first circuit for applying a first potential satisfying a negative correlation with the potential on the wiring to the comparator; and a second circuit for applying a second potential, which continuously falls or falls in stepwise manner in the predetermined period, to the comparator; wherein the comparator outputs a result of comparison between the first potential and the second potential.

A third aspect of the present invention provides an image display apparatus comprising: an electron source; a light-emitting member for emitting a light by irradiation with electrons emitted from the electron source; an anode electrode, which is arranged being opposed to the electron source; a high-voltage generating circuit for generating a potential which rises in a predetermined period; a first wiring for connecting the anode electrode to the high-voltage generating circuit; a second wiring which is connected to the anode electrode; a comparator; a first circuit for applying a first potential satisfying a positive correlation with the potential on the second wiring to the comparator; and a second circuit for applying a second potential, which continuously rises or rises in stepwise manner in the predetermined period, to the comparator; wherein the comparator outputs a result of comparison between the first potential and the second potential.

A fourth aspect of the present invention provides an image display apparatus comprising: an electron source; a light-emitting member for emitting a light by irradiation with electrons emitted from the electron source; an anode electrode, which is arranged being opposed to the electron source; a high-voltage generating circuit for generating a potential which rises in a predetermined period; a first wiring for connecting the anode electrode to the high-voltage generating circuit; a second wiring which is connected to the anode electrode; a comparator; a first circuit for applying a first potential satisfying a negative correlation with the potential on the second wiring to the comparator; and a second circuit for applying a second potential, which continuously falls or falls in stepwise manner in the predetermined period, to the comparator; wherein the comparator outputs a result of comparison between the first potential and the second potential.

Here, "a positive correlation" means a relation between two variables such that as one is increased, the other is also increased. And "a negative correlation" means a relation between two variables such that as one is increased, the other is decreased.

A fifth aspect of the present invention provides an image display apparatus comprising: an electron source; a light-emitting member for emitting a light by irradiation with electrons emitted from the electron source; an anode electrode, which is arranged being opposed to the electron source; a high-voltage generating circuit for generating a potential to be applied to the anode electrode; and a circuit for detecting lowering of the potential of the anode electrode in a period when the potential generated by the high-voltage generating circuit rises.

According to the present invention, it is possible to appropriately detect abnormal variation of the anode potential generated in the display apparatus due to discharge or the like even during a period when a high voltage output is varied, upon starting-up of the display apparatus, for example.

BRIEF DESCRIPTION OF THE DRAWINGS

FIG. 5A shows the case where abnormal discharge, requiring the display operation to stop, is generated in a static state; FIG. 5B shows the case where a single-shot weak discharge is generated; FIG. 5C shows the case where a continuous weak discharge is generated; and FIG. 5D shows the case where a continuous weak discharge is generated upon starting-up;

FIG. 13A shows a normal case; and FIG. 13B shows a case where abnormality is generated;

DESCRIPTION OF THE INVENTION

Preferred embodiments of an image display apparatus according to the present invention will be described.

Constitution of Electric Circuit of Image Display Apparatus

First Embodiment

Figure 1:
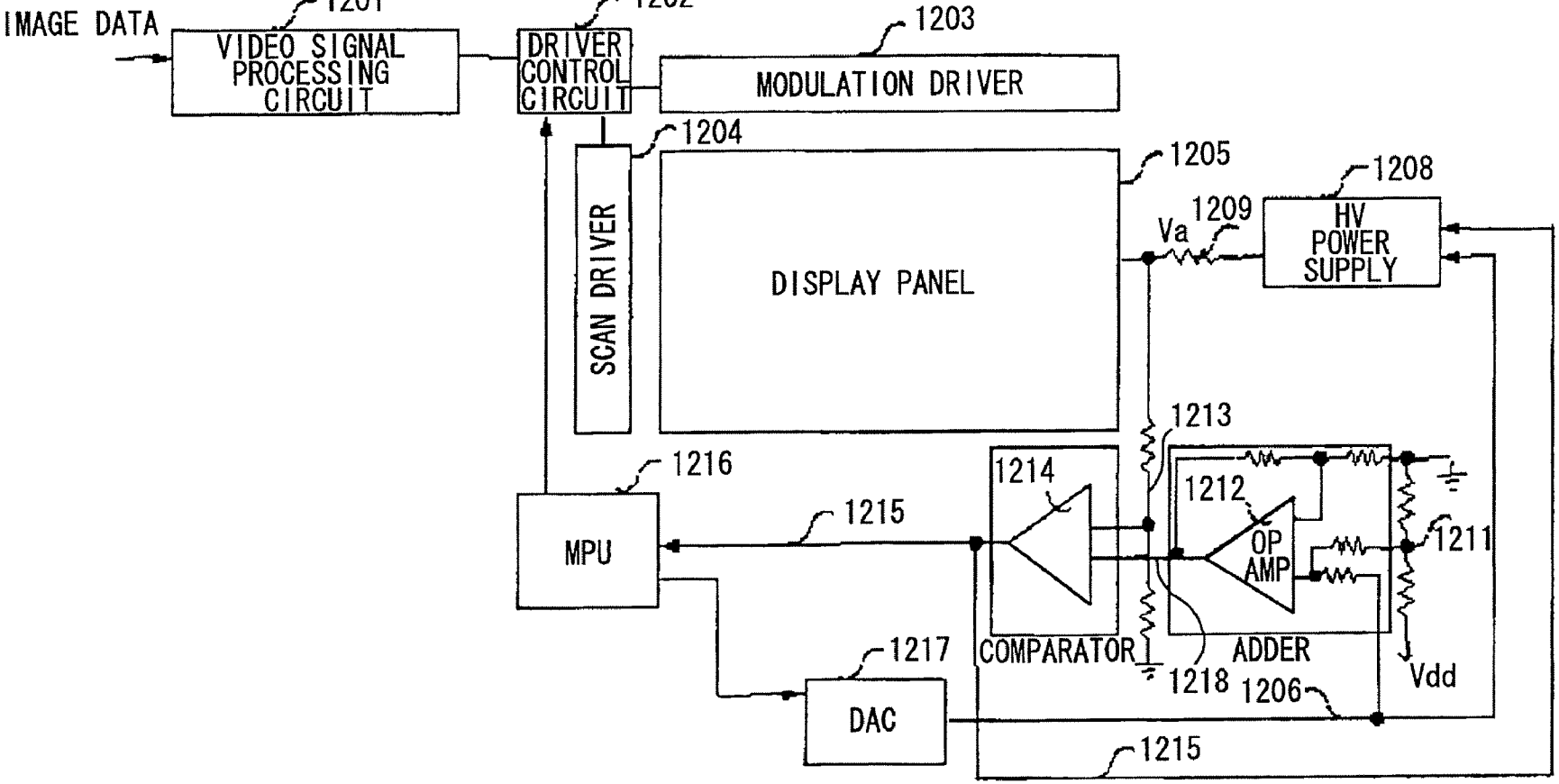
FIG. 1 is a view showing constitutions of electric circuits according to the first embodiment of the present invention and connections thereof.

FIG. 1 is a view showing constitutions of electric circuits according to the present embodiment and connections thereof.

A video signal processing circuit 1201 may create a horizontal synchronizing signal, a vertical synchronizing signal, a digital video signal and the like from a video signal such as an NTSC. The video signal processing circuit 1201 may include a video intermediate frequency circuit, a video detection circuit, a sync separation circuit, a low-pass filter, an A/D converter and the like.

A driver control circuit 1202 may carry out timing control of the following driver. The driver control circuit 1202 is a circuit for outputting a scan signal on the basis of a horizontal synchronizing signal, which is separated and created by the video signal processing circuit 1201.

A modulation driver 1203 may drive a column wiring of a display panel 1205. The modulation driver 1203 may output a modulating signal from a horizontal synchronizing signal, a vertical synchronizing signal, a digital video signal, and the like, which are separated and created by the video signal processing circuit 1201. A scan driver 1204 may drive a row wiring of the display panel 1205.

An MPU 1216 is one chip microprocessor. A DA converter 1217 (hereinafter, referred to as a "DAC") may convert a digital value of a HV output instruction from the MPU 1216 into an analog value and may output an HVPS-input potential 1206. A high-voltage power supply (HVPS) 1208, as a high-voltage generating circuit, may amplify this HVPS-input potential 1206 2,000 times, for example so as to apply a high voltage to an anode electrode via a limiting resistor 1209.

Figure 2A:
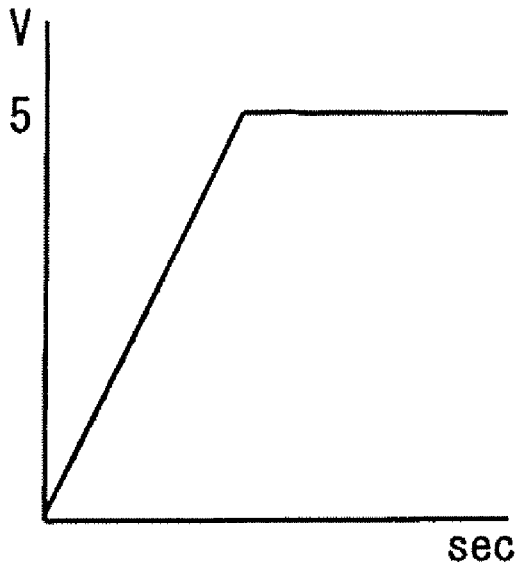
FIG. 2A is a view showing an input potential of a high voltage power source (an HVPS-input potential) upon starting-up and FIG. 2B is a view showing output of a high voltage power source.
Figure 2B:
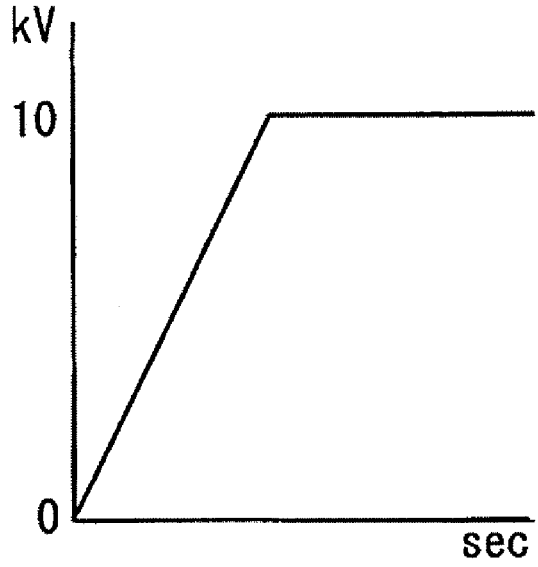

FIG. 2A shows an HVPS-input potential 1206 upon starting-up of an image display apparatus according to the present invention and FIG. 2B shows an output of a high-voltage power supply 1208 in the case where the HVPS-input potential 1206 is amplified 2,000 times, respectively. According to the present embodiment, the MPU 1216 may output instruction for outputting a high voltage to a DAC 1217 so that the output of the high-voltage power supply 1208 is not increased to 10 kV instantaneously but is increased from 0V to 10 kV for three seconds.

Here, it is preferable that a time from start of changing of output of the high-voltage power supply 1208 until it attains to a static state, which is "a predetermined period" of the present invention, is within a range of 100 milliseconds to 10 seconds. If the time is defined to be shorter than 100 milliseconds, overshoot of a high voltage output may be generated, for example, and this is not preferable. On the other hand, it is not preferable to make the predetermined period longer than 10 seconds as a performance of the display apparatus. The length of this predetermined period is not necessarily the same every time. In other words, the predetermined period may be determined anytime before starting change of the output of the high-voltage power supply 1208. Therefore, the length of a predetermined period may be randomly decided every time, for example.

According to the present embodiment, the HVPS-input potential 1206 is inputted to an operational amplifier 1212 which is an adder. An offset voltage 1211 is set to any negative voltage value by two resistors, which are connected to a GND and a negative voltage respectively.

Further, by setting values of all four resistors to the same, which are directly connected to the operational amplifier 1212, an analog adder circuit may be formed with the operational amplifier and the connected four resistors, so that the following formula is obtained.

Operational Amplifier Output 1218=HVPS-input potential 1206+Offset Voltage 1211 (where an offset voltage takes a negative value)

For example, assuming that the HVPS-input potential 1206 is 5V and the offset voltage 1211 is −0.7 V, the operational amplifier 1212 may output the operational amplifier output 1218 of 4.3 V, which is calculated from the HVPS-input potential 1206.

A compared potential 1213 (corresponding to "a first potential" of the present invention) is a potential, which is obtained by lowering the potential of the wiring connecting the anode electrode to the high-voltage power supply 1208. With the combination of high voltage resistances of 200MΩ and 100 kΩ, a potential of about 1/2000 of the high voltage output, which is applied to the anode electrode, is obtained as the compared potential 1213. By thus dividing the high voltage by the resistances (so-called "resistive dividing"), it is possible to compare the compared potential 1213 to the operational amplifier output 1218 which is a reference of comparison. Further, according to the present embodiment, a circuit for resistive dividing corresponds to "a first circuit"; the operational amplifier 1212 corresponds to "a second circuit"; the operational amplifier output 1218 corresponds to "reference potential 1218 (corresponding to "a second potential" of the present invention), and the DAC 1217 corresponds to "a third circuit"; and the HVPS-input potential 1206 corresponds to "a third potential".

The output of a comparator 1214 is changed when a magnitude correlation between the compared potential 1213 (the first potential) and the reference potential 1218 (the second potential) is changed. According to the present embodiment, a signal indicating "H" may be outputted as the output 1215 from the comparator 1214 during a period when the compared potential 1213 is higher than the operational amplifier output 1218 which is the reference potential. On the contrary, the comparator 1214 may output a signal indicating "L" as the output 1215 if the compared potential 1213 is less than the operational amplifier output 1218. In other words, changing of the output of the comparator 1214 from "H" to "L" means that abnormal discharge occurs in the inside of the display panel 1205 and then the anode potential is lowered.

Figure 3:
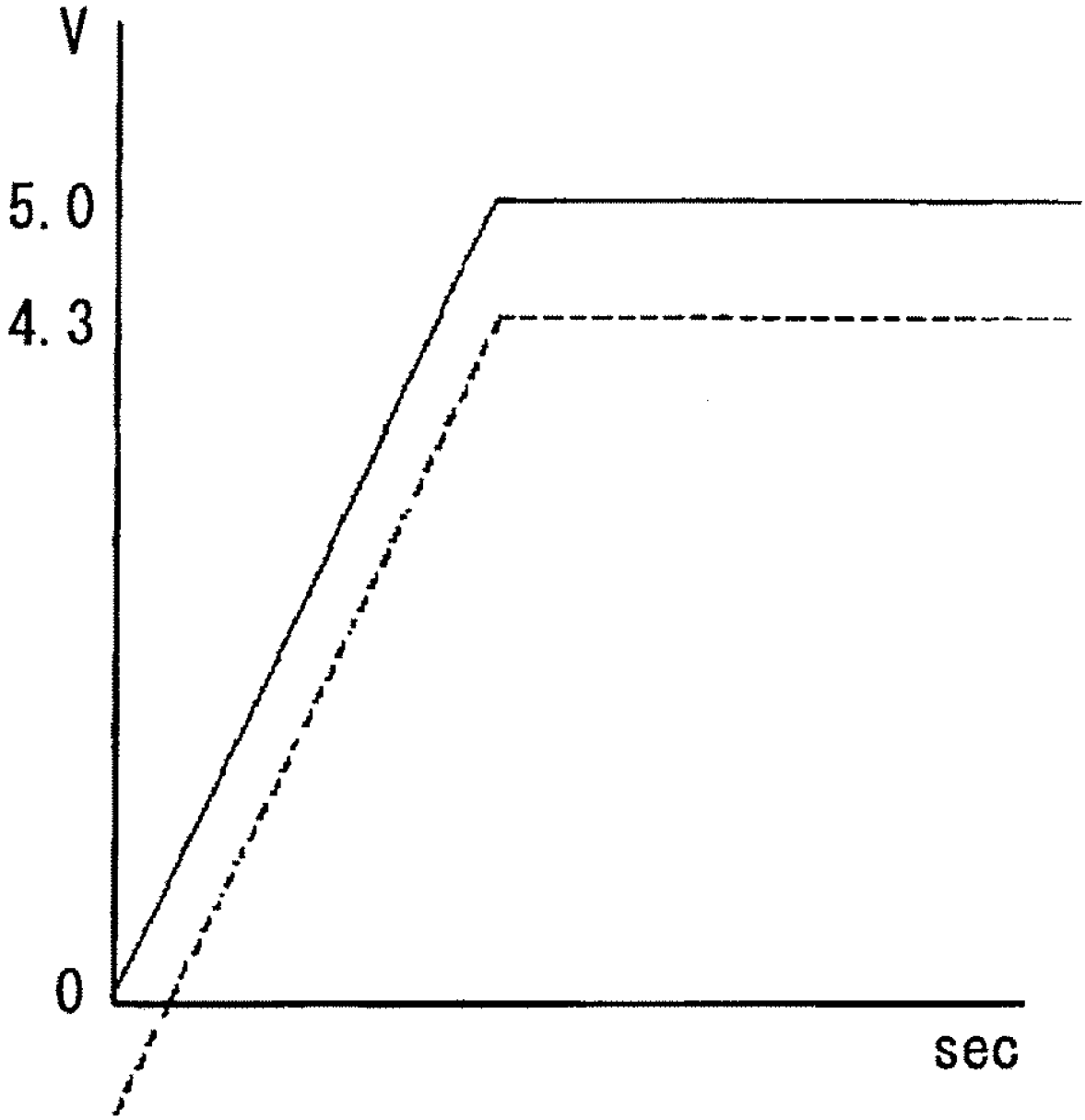
FIG. 3 is a view showing variation of a compared potential (a solid line) and a reference potential (a dotted line) upon starting-up.

FIG. 3 is a view showing variation of a compared potential (a solid line) and a reference potential (a dotted line) upon starting-up of the display apparatus according to the present embodiment. According to the present embodiment, the HVPS-input potential 1206 of the DAC 1217 is set to 0V so that the output of the high-voltage power supply 1208 becomes 0V before the display apparatus is powered-on. Then, the HVPS-input potential 1206 is gradually increased to 5V in three seconds so that the output becomes 10 kV three seconds after the high-voltage power supply 1208 starts output. Therefore, if the offset voltage 1211 is −0.7V, the operational amplifier output 1218 is increased from −0.7V to 4.3V in response to increase of the HVPS-input potential 1206. In other words, the operational amplifier output 1218 is increased by a predetermined potential per unit time and the compared potential 1213 is increased by a predetermined potential per unit time in synchronization with the operational amplifier output 1218. Accordingly, in the case that the display apparatus is normally operated, the compared potential and the reference potential are as shown in FIG. 3.

Figure 4:
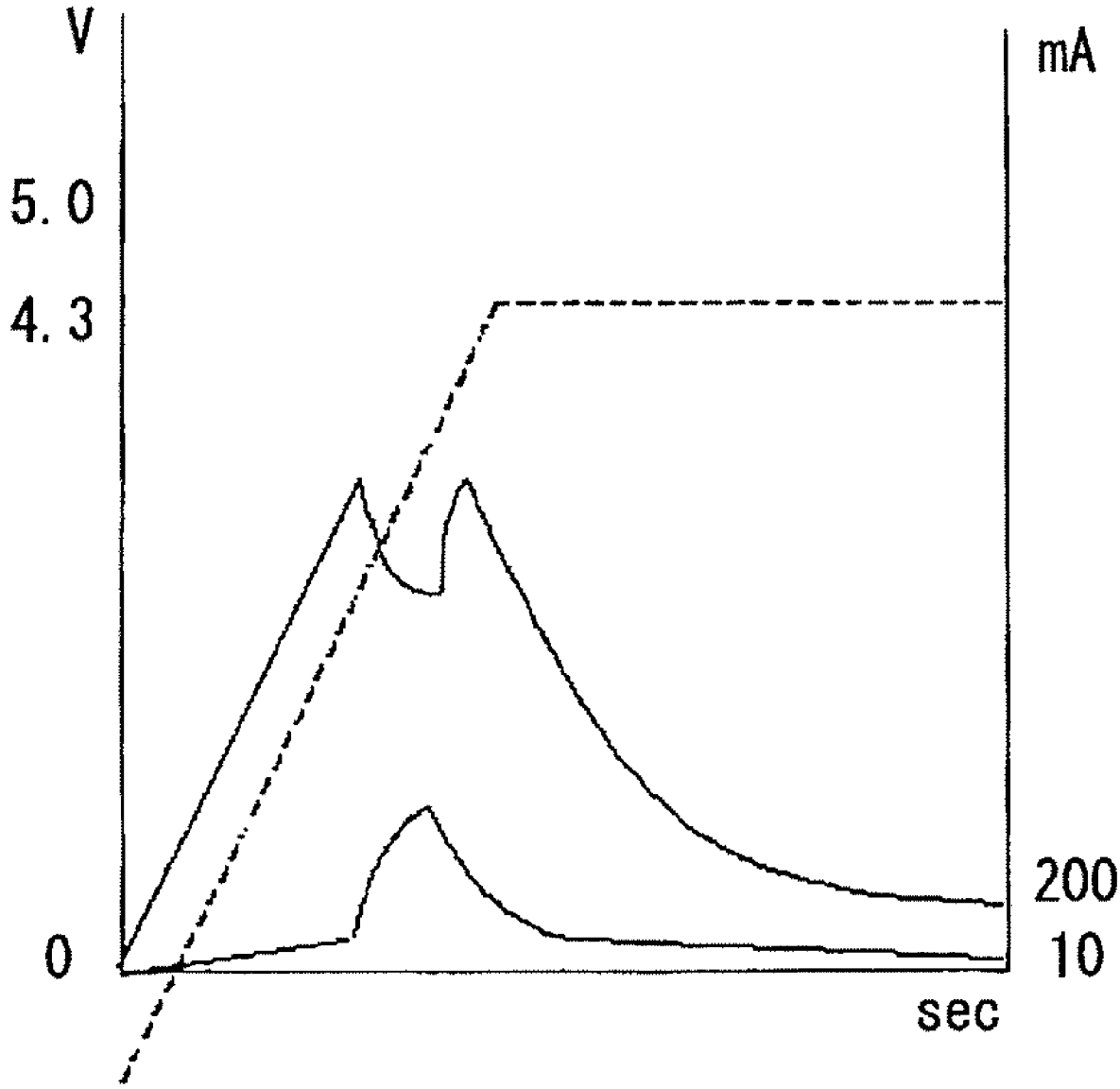
FIG. 4 is a view showing variation of a compared potential, a reference potential, and a high voltage output current in the case that abnormal discharge, requiring the display operation to stop due to this abnormal discharge, is generated upon starting-up.

FIG. 4 shows change of the compared potential when the compared potential 1213 is lowered upon starting-up of the high-voltage power supply 1208 to an potential less than the operational amplifier output 1218 which is the reference potential. Further, FIG. 4 also shows the high voltage output current and shows that a peak of the high voltage output current is about 200 mA. The comparator 1214 may notify the high-voltage power supply 1208 and the MPU 1216 of the output "L" indicating that the compared potential 1213 is less than the operational amplifier output 1218. The high-voltage power supply 1208 may stop the voltage output and the MPU 1216 may stop the driver control circuit 1202, and thereby, the operation of the display panel 1205 is stopped. When the high-voltage power supply 1208 is stopped, the high voltage output is slowly decreased. As a result, according to the present embodiment, the compared potential varies as shown in FIG. 4.

According to the present embodiment, not only after a predetermined time when the output of the high-voltage power supply 1208 becomes 10 kV but also during a predetermined period till the output of the high-voltage power supply 1208 attains to 10 kV, a difference between the compared potential and the reference voltage is held constant at 0.7V. As a result, according to the present embodiment, it is also possible to detect lowering of the anode potential due to generation of abnormal discharge, requiring the display operation to stop, upon starting-up of the high-voltage power supply 1208. In addition, according to the present embodiment it is possible with a simple circuit constitution to protect the display panel 1205 from the discharge sequentially generated as an influence of a gas or an ion generated in the display panel 1205 due to the abnormal discharge generated upon start of the high-voltage power supply 1208.

Figure 5A:
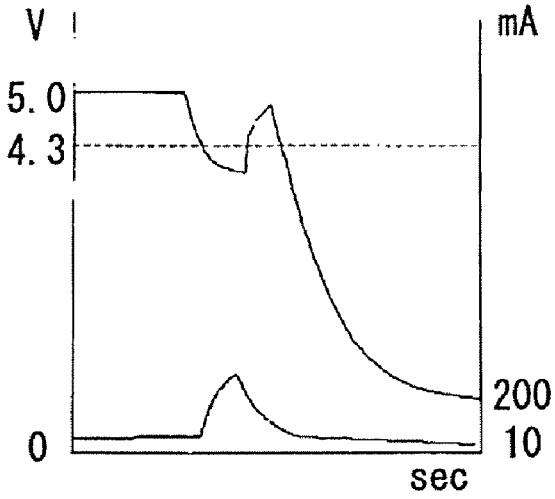
FIGS. 5A to 5D are views showing variation of a compared potential, a reference potential, and a high voltage output current.

Further, according to the present embodiment, the constitution capable of detecting the abnormality of the anode potential upon starting-up of the display apparatus has been described, however, the present invention is not limited to this. For example, the present invention can be applied even in the static state after the anode potential attains to 10 kV as shown in FIG. 5A and even in the case that the anode potential is increased or decreased other than upon starting-up.

Figure 5B:
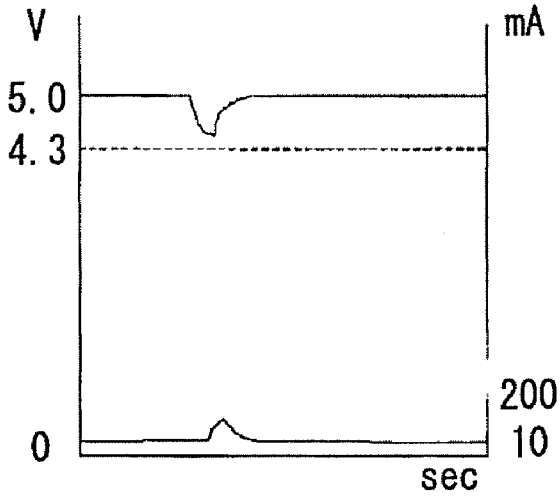

In addition, according to the present embodiment, by setting the offset voltage 1211 to −0.7 V, lowering of a potential of the anode potential to be less than 8.6 kV is detected. Therefore, as shown in FIG. 5B, in the case that a weak discharge, lowering the potential of the wiring connecting the anode electrode to the high-voltage power supply 1208 by less than 1.4 kV (the compared potential is lowered by 0.7 V), is generated, the output from the comparator 1214 remains to be "H" (not detected). The high-voltage power supply 1208 is not stopped, the anode potential is recovered as shown in FIG. 5B, and the operation of the display apparatus is continued as it is. According to the present embodiment, it is possible to ignore a single weak discharge, which does not require stopping the display operation.

Figure 5C:
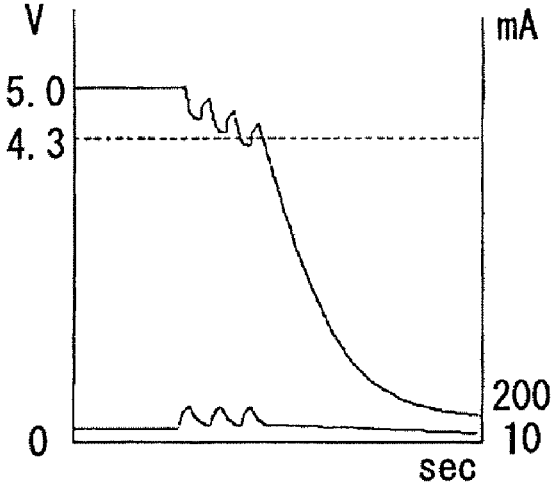
Figure 5D:
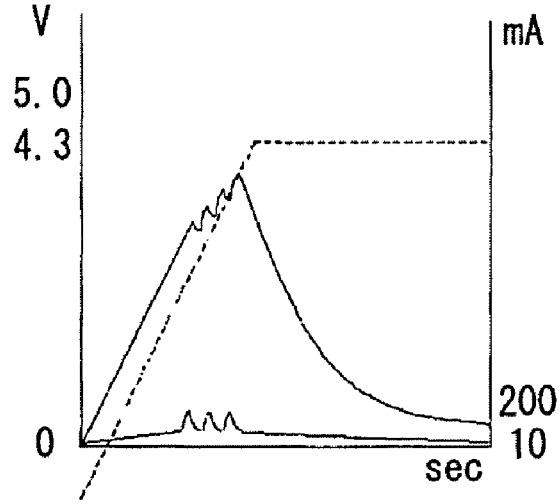

On the contrary, FIG. 5C and FIG. 5D show the compared potential and the reference potential when the weak discharge current is intermittently generated. FIG. 5C and FIG. 5D show the case that the weak current is intermittently generated in the static state and upon starting-up, respectively. When the weak discharge, which can be ignored without stopping the operation of the apparatus if the weak discharge is a single, is intermittently generated, an electron charge to be discharged by one weak discharge is larger than an electron charge supplied by the high-voltage power supply 1208. Therefore, every time the weak discharge occurs, the potential is lowered. Then, if the voltage is lowered by more than 1.4 kV, the comparator 1214 notifies the high-voltage power supply 1208 and the MPU 1216 of the output of "L" via a comparator output wiring 1215. Determining that the output of the comparator 1214 is abnormal, a control circuit provided in the inside of the high-voltage power supply 1208 may stop the output of the high-voltage power supply 1208. When the high-voltage power supply 1208 is stopped, a high-voltage output is slowly decreased.

Further, the operational control of the display apparatus when abnormality is generated in the display apparatus is not limited to stopping of the output of the high-voltage power supply 1208. For example, depending on a magnitude of abnormality generated in the display apparatus, the output potential of the high-voltage power supply 1208 may be lowered without completely stopping the output of the high-voltage power supply 1208. In addition, since the output of the high-voltage power supply 1208 is stopped as soon as possible when abnormality is detected, the output of the comparator 1214 is directly inputted to the high-voltage power supply 1208. However, for example, the MPU 1216 receiving the output of the comparator 1214 may transmit a signal for controlling the output potential to the high-voltage power supply 1208.

The MPU may transmit a control signal for stopping the scan driver 1204 and the modulation driver 1203 to the driver control circuit 1202. Thereby, the operation of the display panel 1205 is stopped.

Further, in the present embodiment, the high-voltage power supply 1208 and the MPU 1216 are notified of the output of the comparator 1214 through the comparator output wiring 1215, however, the present invention is not limited to this. In other words, only one of the high-voltage power supply 1208 and the MPU 1216 of the output of the comparator 1214 may be notified.

According to the present embodiment, it is possible to detect an intermittent weak discharge, which is generated in connection with predischarge phenomena (namely, phenomena that prior to discharge instantaneously generated, a current which is relatively smaller than this discharge flows). Therefore, it is possible to control the display apparatus before large discharge and to prevent the influence of discharge from being given to the electron source and the wiring of the peripheral parts.

Further, the volume of the offset voltage according to the present embodiment is not limited to −0.7 V. In other words, it is preferable that the volume of the offset voltage is appropriately determined in response to a degree of variation of the anode potential due to abnormality to be detected so that lowering of the anode potential due to abnormal discharge, requiring the display operation to stop, generated in the inside of the display panel can be detected.

Figure 6:
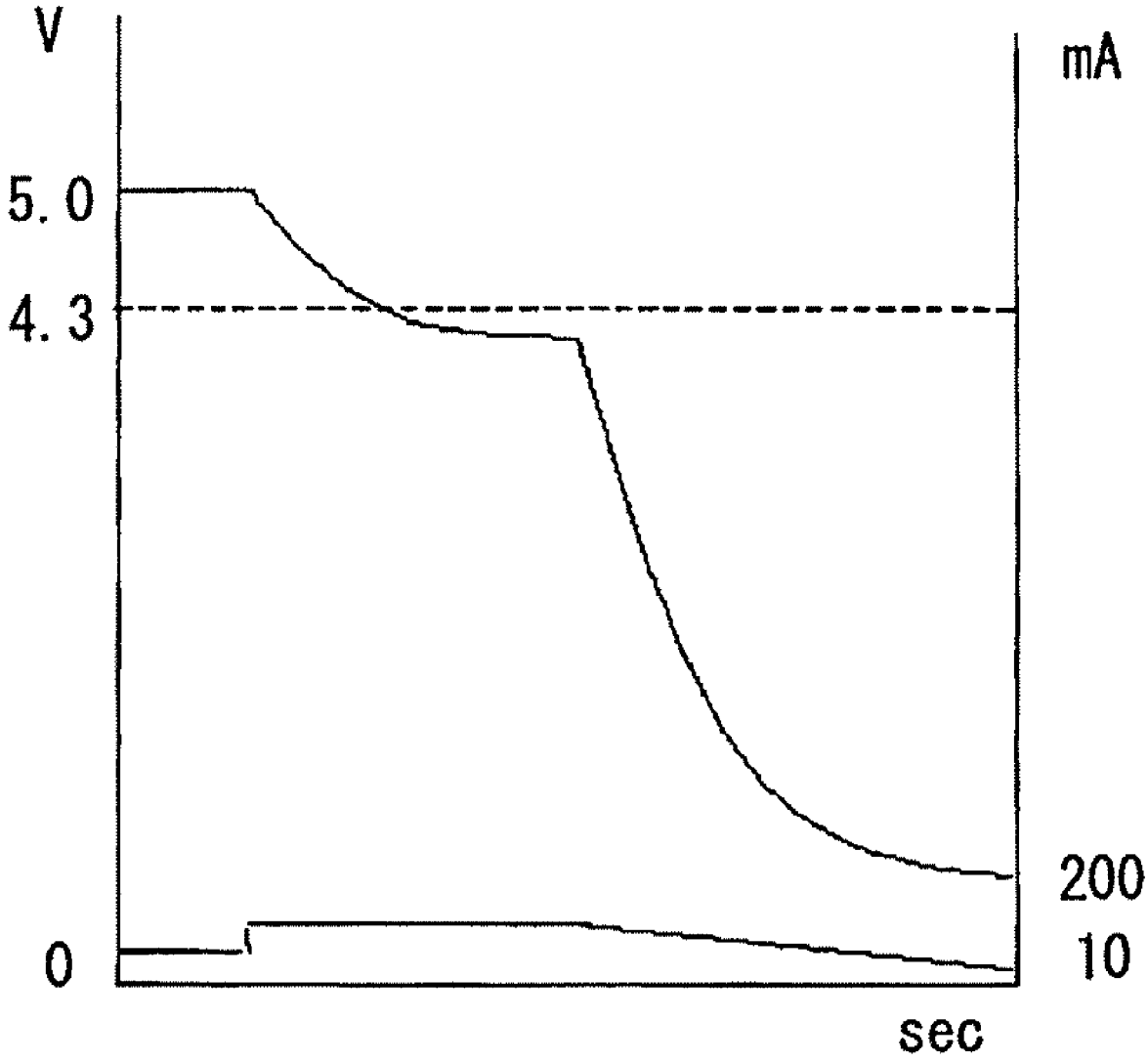
FIG. 6 is a view showing variation of a compared potential, a reference potential, and a high voltage output current in the case where a current leakage (a leakage) of a high voltage output occurs.

FIG. 6 is a view showing variation of a compared potential in the case that a current leakage (a leakage) of a high voltage output occurs. When insulation of an insulation part of the display panel 1205 or the like is broken and a current leakage occurs, a current supplied to the anode electrode is larger than a rated current. If the current more than the rated current is supplied to the high-voltage power supply 1208, it is possible to supply the enough electric charge to the anode electrode, so that the compared potential is lowered as shown in the drawing. If the potential is thus lowered by more than 1.4 kV, the comparator 1214 may detect abnormality.

Thus, the present invention can be appropriately applied not only for detecting lowering of a potential due to generation of discharge but also for detecting of lowering of potential due to generation of a current leakage (leakage).

Second Embodiment

Figure 7A:
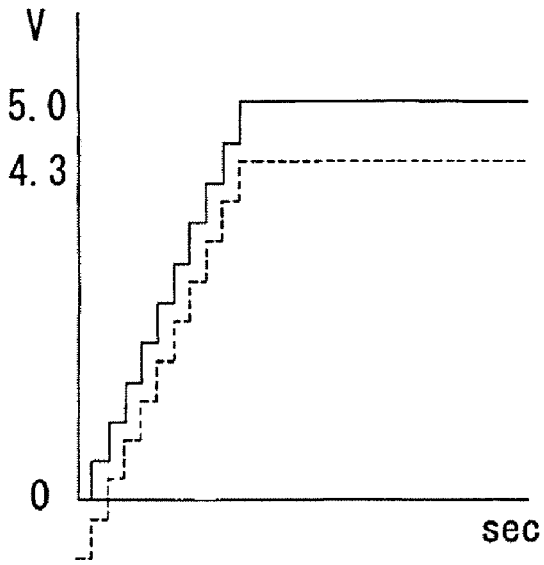
FIG. 7A is a view showing stepwise variation of a compared potential and stepwise variation of a reference potential.
Figure 7B:
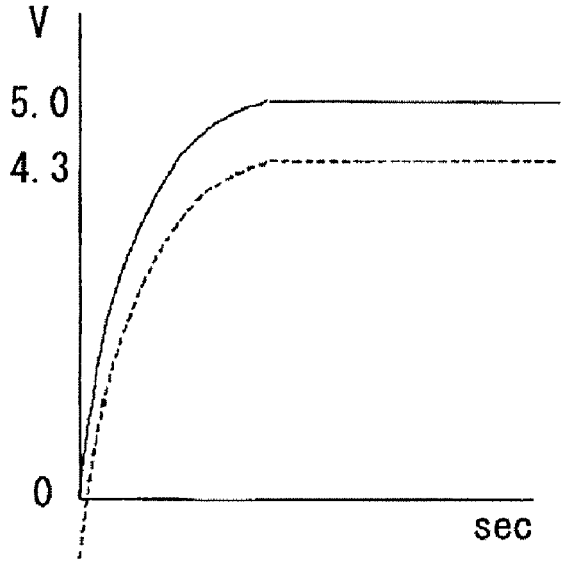
FIG. 7B is a view showing curved-wave variation of a compared potential and curved-wave shift of a reference potential.

According to the first embodiment, the output of the high-voltage power supply 1208 is increased up to 10 kV in a ramp-wave, which continuously rise, during a predetermined period as shown in FIG. 2, however, the present invention is not limited to this. For example, the present invention may be applied to a stepwise-wave rising in stepwise manner or a curved-wave continuously rising, may be available. FIG. 7A and FIG. 7B show a compared potential and a reference potential in the case that the output of the high-voltage power supply 1208 is formed in stepwise-wave and the curved-wave, respectively.

Even these waveforms can hold a difference between the compared potential and the reference potential constant (namely, 0.7V) during a predetermined period till the output of the high-voltage power supply 1208 attains to 10 kV. As a result, according to the present invention, it is possible to detect lowering of the anode potential due to generation of abnormal discharge, requiring the display operation to stop, upon starting-up of the high-voltage power supply 1208.

Third Embodiment

Figure 8:
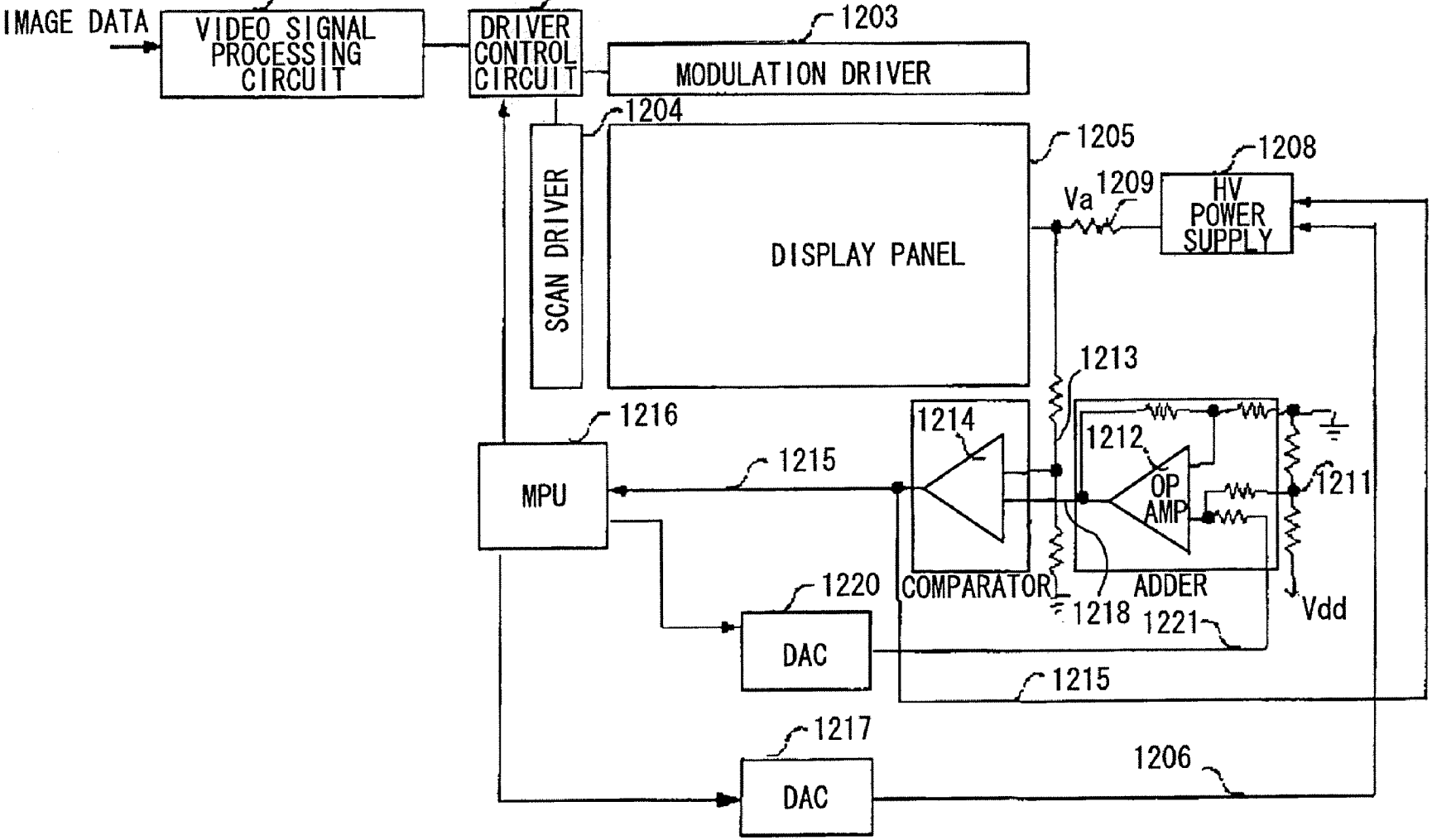
FIG. 8 is a view showing constitutions of electric circuits according to a third embodiment and connections thereof.
Figure 9:
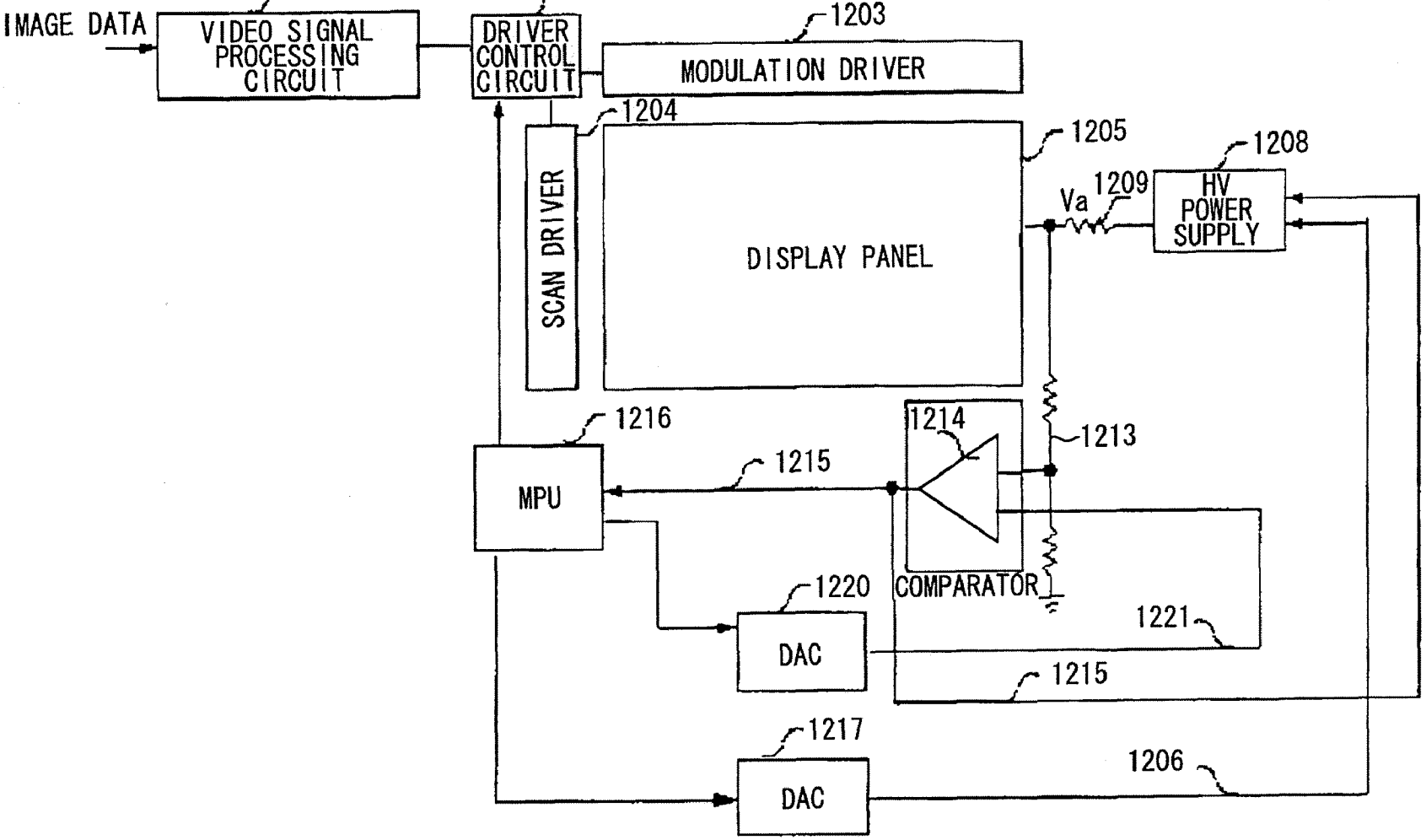
FIG. 9 is a view showing constitutions of electric circuits according to a third embodiment and connections thereof.

According to the above-described embodiments, the HVPS-input potential 1206 which is the output of the DAC 1217 is inputted to both of the high-voltage power supply 1208 and the operational amplifier 1212. However, the present invention is not limited to this. In other words, the invention may be embodied as long as the reference potential to be inputted to the comparator 1214 changes allowing to detect change of the compared potential 1213 in response to lowering of the anode potential due to abnormal discharge, requiring the display operation to stop, in a predetermined period till the output of the high-voltage power supply 1208 attains to 10 kV. For example, as shown in FIG. 8, an output potential 1221 of a DAC 1220 other than the DAC 1217, which outputs HVPS-input potential, may be a reference potential 1218 (corresponding to "the second potential") to be inputted to the comparator 1214 finally via the operational amplifier (corresponding to "the second circuit"). In addition, as shown in FIG. 9, the output potential 1211 (corresponding to "the second potential") of the DAC 1220 (corresponding to "the second circuit") may be directly inputted to the comparator 1214.

Figure 10:
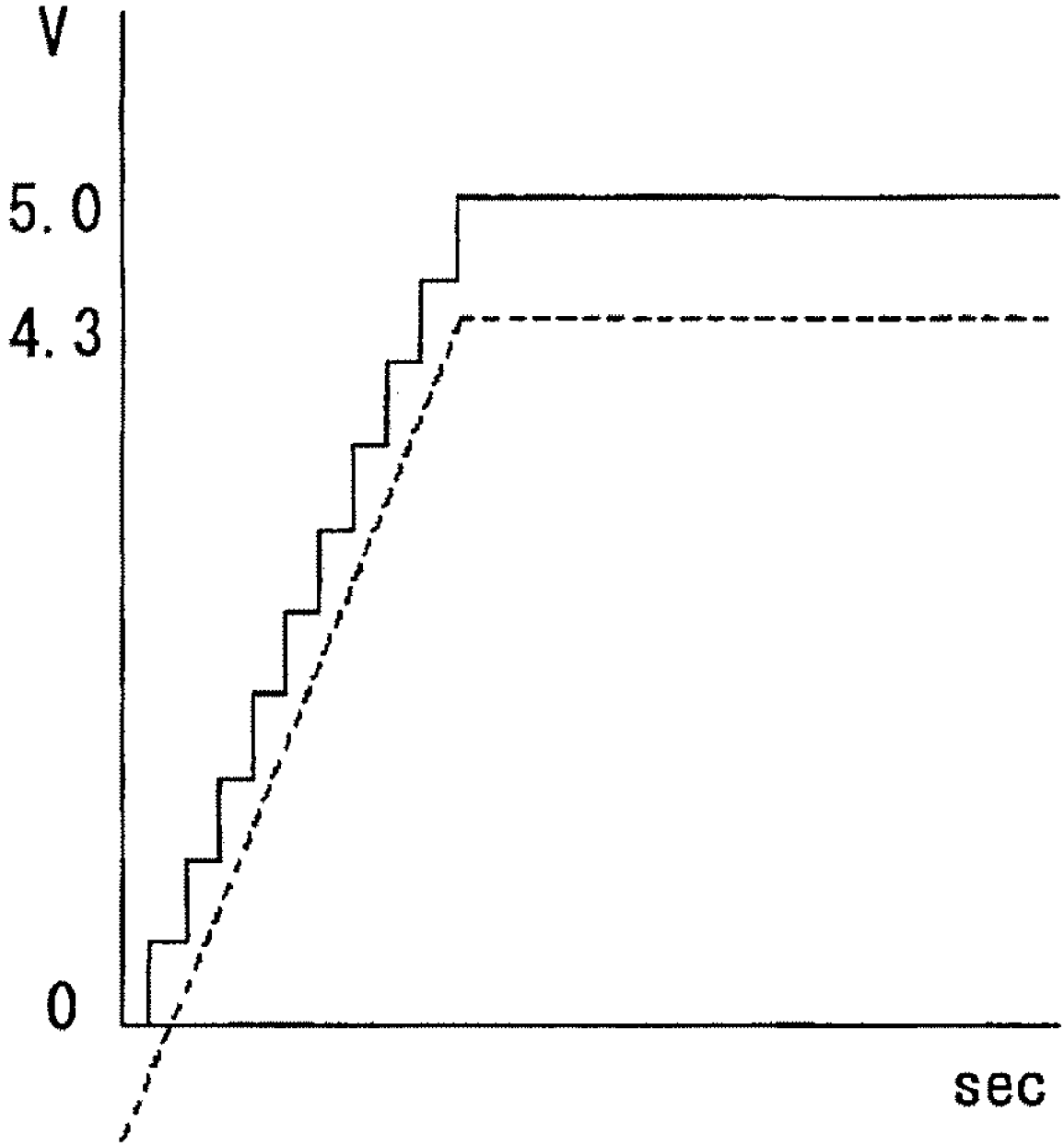
FIG. 10 is a view showing stepwise variation of a compared potential (a solid line) and ramp-waved variation of a reference potential (a dotted line)

In this case, as shown in FIG. 3 and FIG. 7, the compared potential 1213 and the reference potential 1218 in a normal case do not always have a constant potential difference. For example, as shown in FIG. 10, the output of the high-voltage power supply 1208 (namely, the compared potential 1213 in the normal case) may be a stepwise-wave while the reference potential may be a ramp-wave.

Fourth Embodiment

According to the above-described embodiments, the potential of the wiring connecting the anode electrode to the high-voltage power supply 1208 is lowered and the HVPS-input potential 1206 is inputted to the comparator 1214 through the operational amplifier output 1218, however, the present invention is not limited to these. Depending on a value of a potential which can be inputted to the comparator 1214, for example, about 1/1000 of the potential of the wiring to connect the anode electrode to the high-voltage power supply 1208 may be defined to be a compared potential and a potential obtained by amplifying the operational amplifier output 1218 into double-fold may be defined to be a reference potential.

Fifth Embodiment

Figure 11:
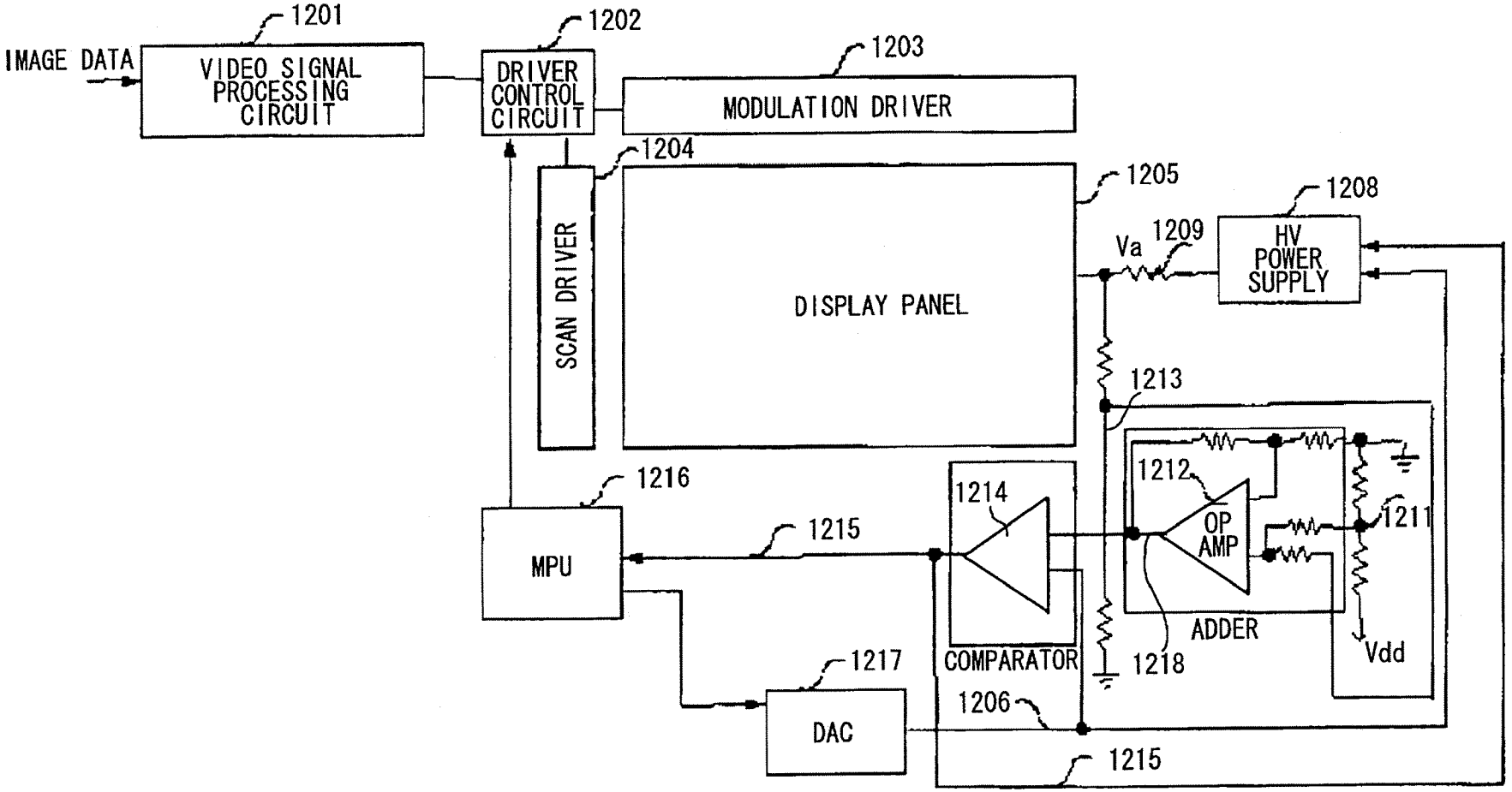
FIG. 11 is a view showing constitutions of electric circuits according to a fifth embodiment and connections thereof.

According to the above-described embodiments, the reference potential is defined by applying a negative offset voltage. According to the fifth embodiment of the present invention, the compared potential is defined by applying a positive offset voltage. As shown in FIG. 11, the operational amplifier output 1218 for adding a positive offset voltage (+0.7V) to about 1/2000 of the potential of the wiring for connecting the anode electrode to the high-voltage power supply 1208 by resistive dividing is determined to be a compared potential. In addition, the HVPS-input potential 1206 which is the output from the DAC 1217 is directly inputted to the comparator not through the operational amplifier so as to be determined to be a reference potential. Also according to the present embodiment, it is possible to detect lowering of the anode potential due to generation of abnormal discharge, requiring the display operation to stop, upon starting-up of the high-voltage power supply 1208.

Further, according to the present embodiment, the resistance for resistive dividing of the anode potential and the operational amplifier 1212 for adding the offset voltage correspond to "the first circuit", the operational amplifier output 1218 corresponds to "the first potential", the DAC 1217 corresponds to "the second circuit", and the HVPS-input potential 1206 corresponds to "the second potential".

Sixth Embodiment

According to the above-described embodiments, to the comparator 1214, an analog compared potential and an analog reference potential having fast response rates are inputted, however, the present invention is not limited to this. In other words, in the process of converting the anode potential into the compared potential, an AD converter for converting the analog potential to digital value may be provided and in the same way, the operational amplifier output 1218 may be converted to digital value to be a reference potential and then, the digital values thus obtained may be compared by a digital comparator.

Seventh Embodiment

Figure 12:
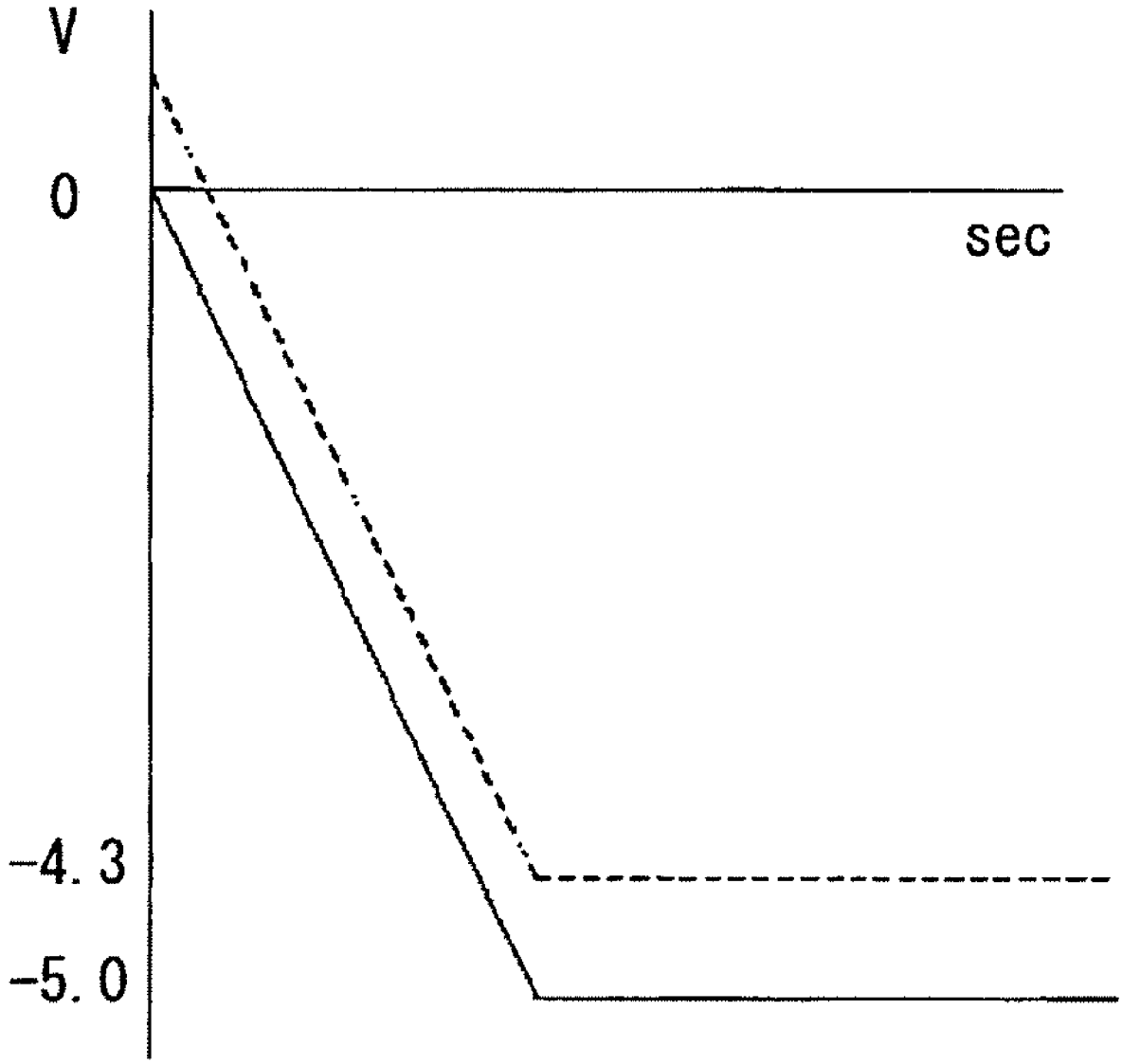
FIG. 12 is a view showing variation of a compared potential (a solid line) and a reference potential (a dotted line) according to a seventh embodiment.

According to the above-described embodiments, a potential obtained by dividing a potential of a wiring for connecting the anode electrode to the high-voltage power supply 1208 using resistors, or a potential, obtained by passing the divided potential through the operational amplifier for further applying the offset voltage, is determined to be the compared potential 1213. In other words, the potential of the wiring for connecting the anode electrode to the high-voltage power supply 1208 and the compared potential have a positive correlation. FIG. 12 shows the compared potential 1213 (a solid line) and the operational amplifier output 1218 (a dotted line) according to the seventh embodiment of the present invention.

According to the present embodiment, the potential of the wiring for connecting the anode electrode to the high-voltage power supply 1208 and the compared potential have a negative correlation. For example, in the process of converting the potential of the wiring for connecting the anode electrode to the high-voltage power supply 1208 into the compared potential, an inverting circuit for inverting a sign of a potential is used, or the like. In other words, during a predetermined period till the output of the high-voltage power supply 1208 is increased to attain to 10 kV, the compared potential 1213 becomes the output which falls down to −5.0V. In this case, in order to detect change of the compared potential 1213 due to lowering of the anode potential, it is necessary for the reference potential 1218 to be lowered while keeping a higher potential than the compared potential 1213. According to the present embodiment, as shown in FIG. 12, the reference potential 1218 is lowered in a ramp-wave which continuously falls during a predetermined period, however, the present invention is not limited to this. For example, the stepwise-wave falling in stepwise manner and a curved-wave continuously falling may be available.

For example, as shown in FIG. 1, in the case that the HVPS-input potential 1206 which is the output from the DAC 1217 is inputted to both of the high-voltage power supply 1208 and the operational amplifier 1212, the sign of the potential may be inverted by the operational amplifier or the like in the process of obtaining the reference potential 1218.

In addition, as shown in FIG. 8, in the case that the output potential 1221 from the DAC 1220 other than the DAC 1217 is inputted to the operational amplifier 1212, the sign of the potential may be inverted in the process of obtaining the reference potential 1218 or the potential outputted by the DAC 1220 itself may be the potential falling during a predetermined period.

Eighth Embodiment

Figure 13A:
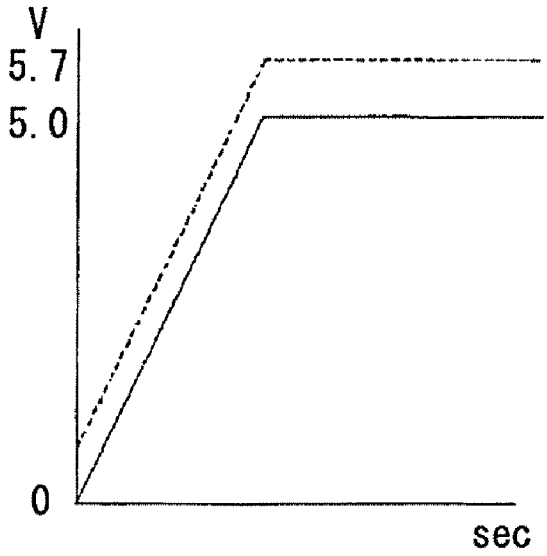
FIG. 13A and FIG. 13B are views showing variation of a compared potential (a solid line) and a reference potential (a dotted line) according to an eighth embodiment.

According to the above-described embodiments, the reference potential is changed so as to be capable of detecting change of compared potential in response to lowering of the anode potential due to generation of abnormal discharge or the like, requiring the display operation to stop. In the eighth embodiment according to the present invention, the reference voltage may be changed so that change of the compared potential in response to rapid rising of the anode potential which is an unacceptable level of deviation for a predetermined waveform can be detected. More specifically, when a high voltage is applied to the anode potential earlier than a predetermined time upon starting-up of the display apparatus, the reference potential is changed so as to be capable of preventing overshoot from being generated. FIG. 13A shows the compared potential 1213 and the operational amplifier output 1218 according to the eighth embodiment of the present invention. About 1/2000 of the high voltage output, which is applied to the anode electrode, is obtained by resistive dividing is defined to be the compared potential 1213. The reference potential 1218 the operational amplifier output 1218 obtained by applying a positive offset voltage (+0.7V) to the HVPS-input potential 1206.

Operational Amplifier Output 1218=HVPS-input potential 1206+Offset Voltage 1211 (where, an offset voltage takes a positive value)

Figure 13B:
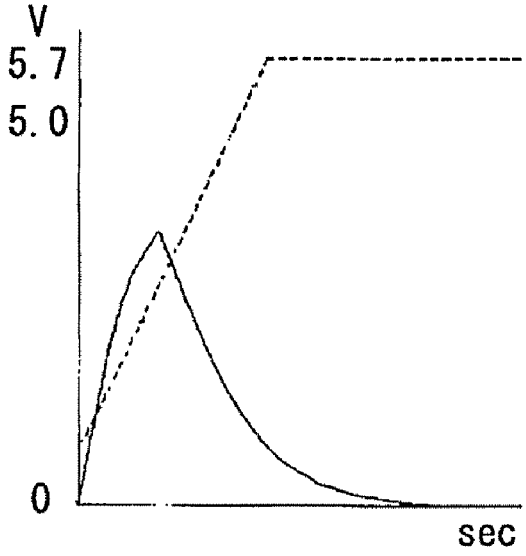

FIG. 13B shows change of the compared potential when the compared potential 1213 rapidly rises upon starting-up of the high-voltage power supply 1208 and it exceeds the operational amplifier output 1218 which is the reference potential. According to the present embodiment, detecting rapid rise of the anode potential, the output of the high-voltage power supply 1208 is stopped, so that the compared potential is as shown in FIG. 13B.

Further, the present embodiment may be combined to the above-described embodiments. In other words, the same compared potential may be inputted to a plurality of comparators, the reference potential of a certain comparator may be set to allow to detect lowering of the anode potential and the reference potential of other comparator may be set to allow to detect rapid rising of the anode potential like the present embodiment.

As being clearly known from the above descriptions, the first circuit and the second circuit may be constituted so as to be capable of detecting that the potential in the wiring connected to the anode electrode is deviated from a predetermined waveform so much as requiring specific treat of the display apparatus.

Ninth Embodiment

According to the above-described embodiments, the reference potential is changed so that change of the compared potential in response to lowering of the anode potential, rapid rising of the anode potential due to generation of abnormal discharge, or the like can be detected. In other words, a magnitude correlation between the compared potential and the reference potential when the display apparatus is normally operated is not inverted. However, the present invention is not limited to such a constitution.

Figure 14:
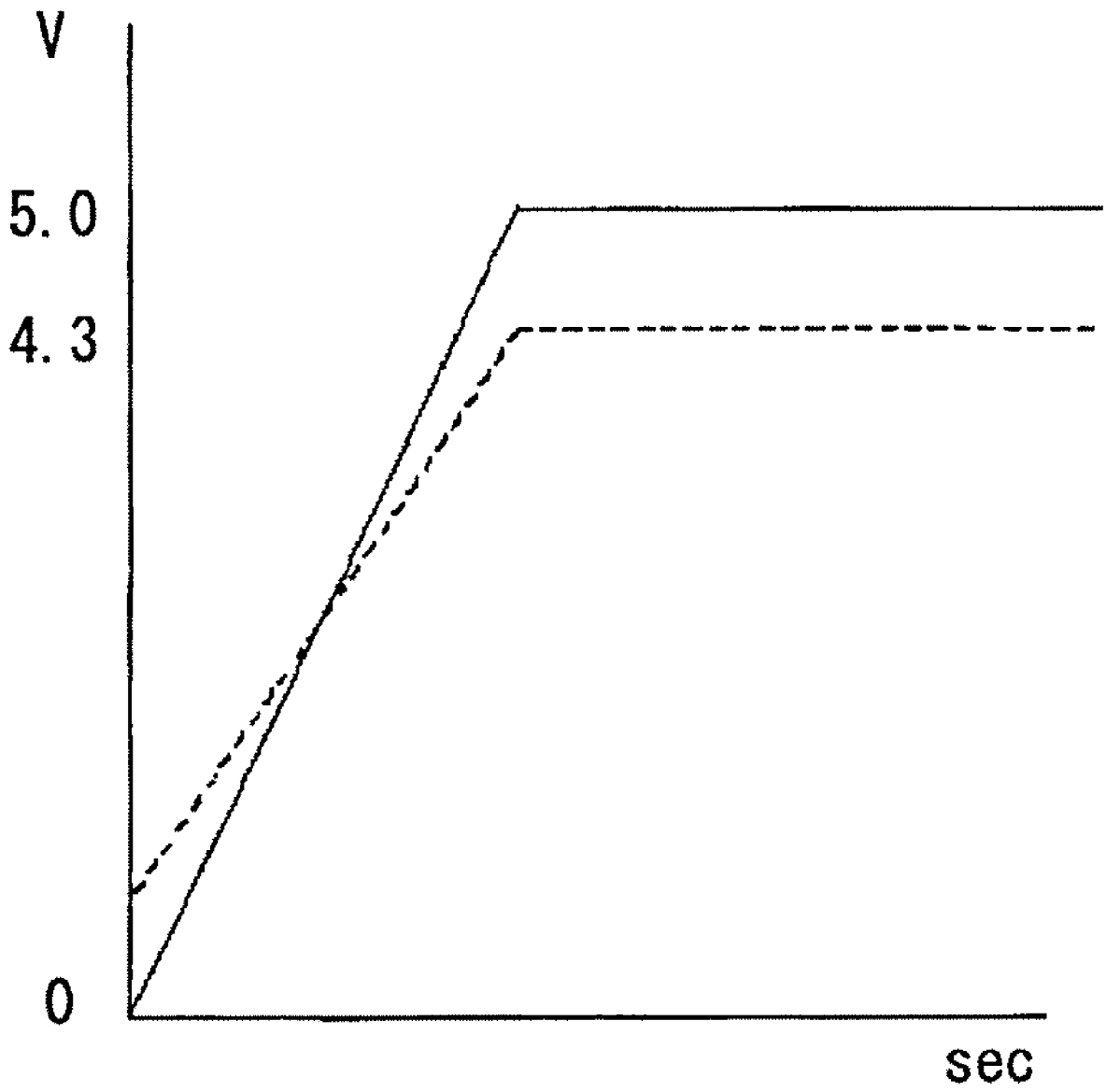
FIG. 14 is a view showing variation of a compared potential (a solid line) and a reference potential (a dotted line) according to a ninth embodiment.

In the ninth embodiment according to the present invention, the reference potential 1218 is changed so that the magnitude correlation between the compared potential 1213 and the reference potential 1218 is inverted in the case that the high-voltage power supply 1208 is normally operated as shown in FIG. 14 during a predetermined period till the output of the high-voltage power supply 1208 rises and attains to 10 kV.

Figure 15A:
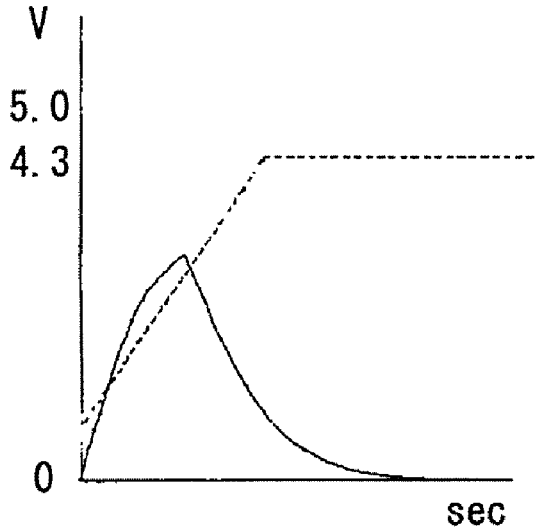
FIG. 15A is a view showing variation of a compared potential, a reference potential, and a high voltage output current in the case where abnormality is generated on an initial stage of a starting period.
Figure 15B:
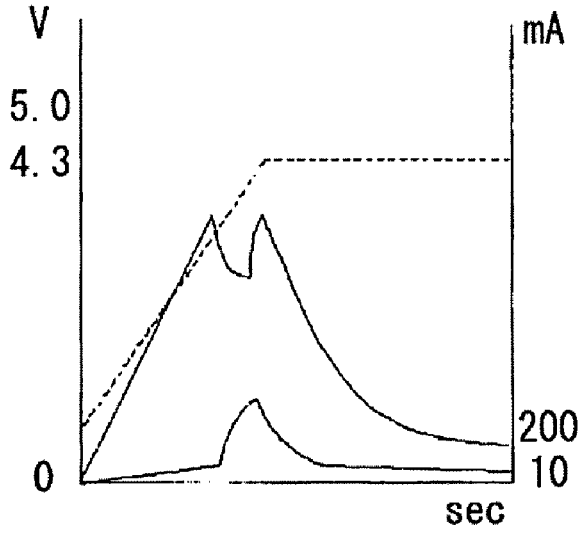
FIG. 15B is a view showing shift of a compared potential, a reference potential, and a high voltage output current in the case that abnormality is generated on a latter stage of the starting period.

According to the present embodiment, as shown in FIG. 15A, on the initial state of a rising period, it is possible to detect change of the compared potential in response to rapid rising of the anode potential. In addition, as shown in FIG. 15B, on a latter stage of the rising period, it is possible to detect change of the compared potential in response to lowering of the anode potential due to generation of abnormal discharge or the like.

In the present embodiment, it is determined that abnormality, requiring specific treat of the display apparatus, is generated when the compared potential is higher than the reference potential during a time period from starting of output of the high-voltage power supply till a specific time. And during a period from the specific time till end of a predetermined period, it is determined that abnormality, requiring specific treat of the display apparatus, is generated when the compared potential is less than the reference potential.

As a specific treat, as same as the above-described embodiments, the following controls, namely, stopping of the operation of the high-voltage power supply 1208, stopping of the output of the modulation driver 1203, and stopping of the output of the scan driver 1204 can be carried out. Even when the abnormalities are not generated, the magnitude correlation between the compared potential and the reference potential is inversed during a specific time period. In this embodiment, the inversion is to be ignored. Therefore, the present embodiment can be used in the case that the anode potential is low and discharge is not generated or discharge is not necessarily detected even when the discharge is generated, like the initial stage of the rising period.

Tenth Embodiment

According to the above-described embodiments, the potential of the anode electrode is monitored by the potential of the wiring connecting the anode electrode to the high-voltage power supply 1208. However, the potential of the anode electrode can be monitored on a position other than the wiring (corresponding to "the first wiring") to connect the anode electrode to the high-voltage power supply 1208.

Figure 16:
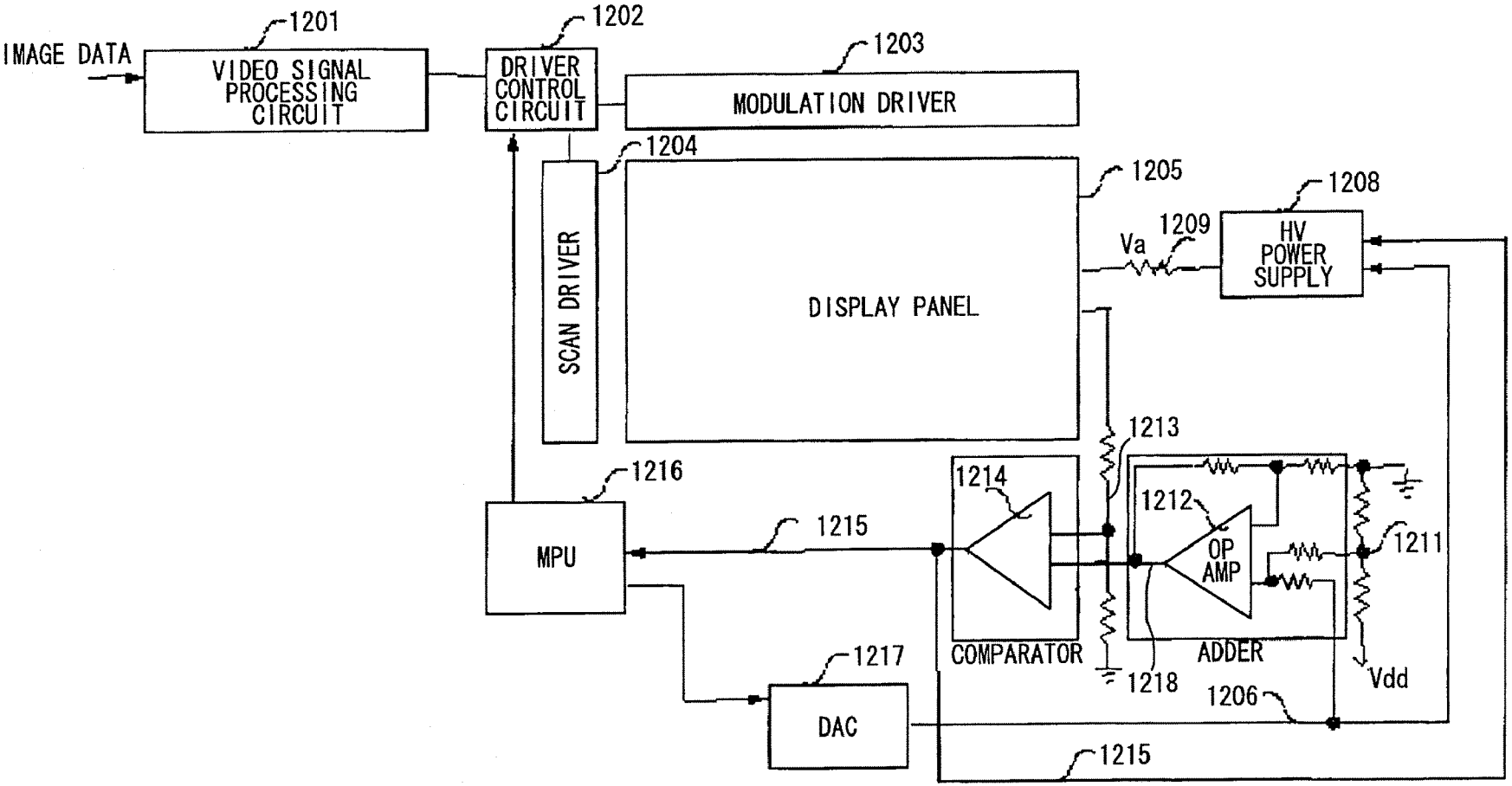
FIG. 16 is a view showing constitutions of electric circuits according to a tenth embodiment and connections thereof.

For example, as shown in FIG. 16, the potential of the anode electrode can be also monitored by the potential of the wiring (corresponding to "the second wiring") which is connected to the anode electrode, but not the high-voltage power supply 1208.

(Constitution of Display Panel)

Next, the constitution of a display panel of an image display apparatus to which the present invention can be applied and a manufacturing method thereof will be described showing a specific example.

Figure 17:
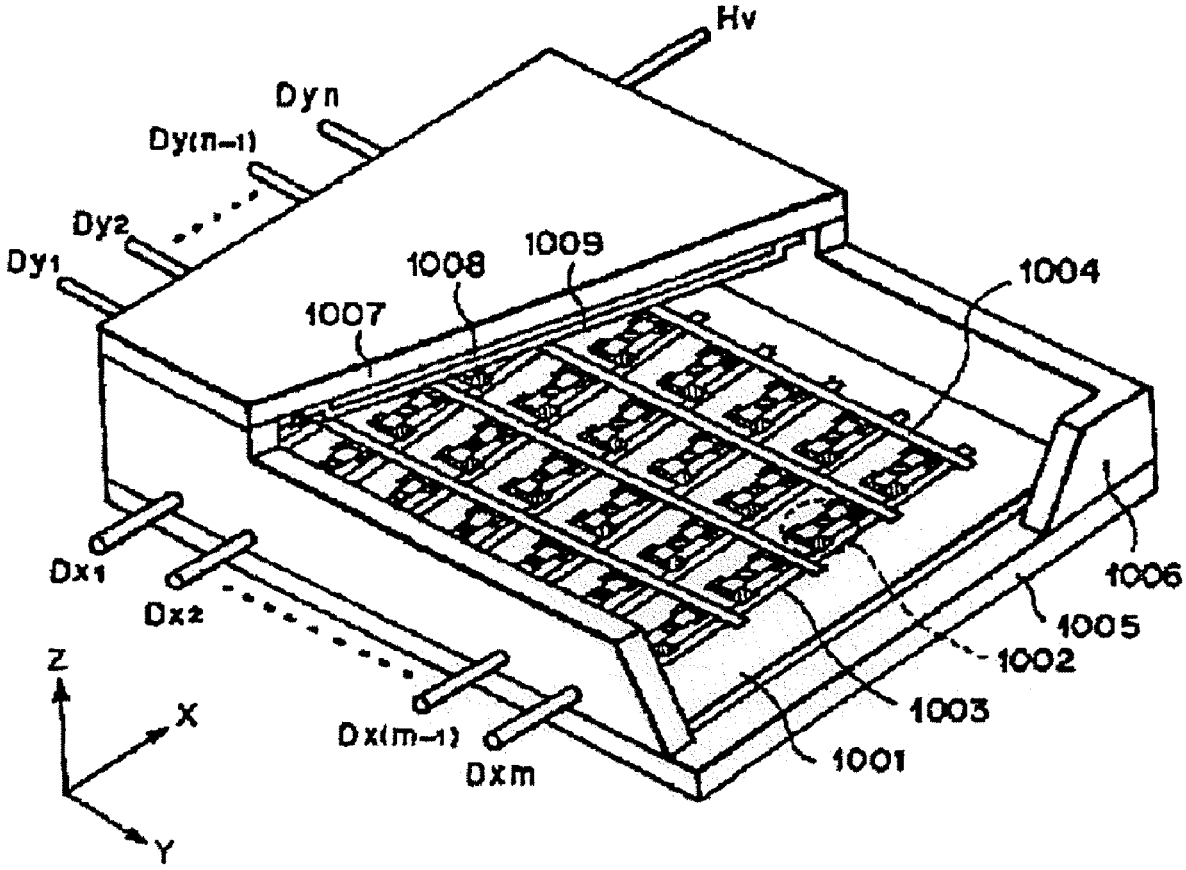
FIG. 17 is a perspective view of a display panel used for the present invention.

FIG. 17 is a perspective view of a display panel which is used for the present embodiment while cutting a part of the display panel in order to show the inner structure.

In FIG. 17, a reference numeral 1005 denotes a rear plate; a reference numeral 1006 denotes a sidewall; a reference numeral 1007 denotes a faceplate; and reference numerals 1005 to 1007 denotes components forming an airtight housing for keeping the inside of the display panel vacuum. When assembling the airtight housing, it is necessary to seal junction parts of respective members in order to allow these junction parts thereof to hold sufficient strength and airtightness. For example, applying a frit glass as an adhesion bond on the junction part and burning the frit glass at 400 to 500 degrees Celsius in air or in a nitrogen atmosphere, sealing has been achieved. A method for exhausting the inside of the airtight housing to make the airtight housing vacuum will be described later.

A substrate 1001 is fixed on the rear plate 1005. On the substrate 1001, N×M pieces of cold cathode devices 1002 as electron sources are formed. Here, N and M are positive integers no less than 2 and they are appropriately determined in response to the targeted number of display pixels. For example, in the display apparatus aiming to display of an advanced television, it is preferable that the numbers no less than N=3000, M=1000 are set. According to the present embodiment, it is determined that N=3072, M=1024. The N×M pieces of cold cathode devices 1002 are arranged on intersecting points of simple matrix wirings, which are formed with M pieces of wirings in row direction 1003 and N pieces of wirings in column direction 1004.

According to the present invention, the substrate 1001 of the electron source is fixed to the rear plate 1005 of the airtight housing, however, in the case that the substrate 1001 of the electron source has a sufficient strength, the substrate 1001 of the electron source itself may be used as the rear plate of the airtight housing.

In addition, a fluorescent film 1008 which is a light-emitting member emitting a light by irradiation with electrons emitted from the electron source and a metal back 1009 which is an anode electrode are formed on a lower surface of a faceplate 1007 forming a fluorescent plate. A fluorescence substance and the metal back 1009 are arranged in a plane state being opposed to the cold cathode device 1002. The present embodiment provides a color display apparatus, so that a portion of the fluorescent film 1008 is color-coded by fluorescence substances of three primary colors including red, green, and blue to be used for a field of a CRT. The fluorescence substance of each color is color-coded in stripes and a black conductive material 1010 is disposed between the stripes of the fluorescence substance. An object of disposing the black conductive material 1010 is to prevent a display color from being displaced even when an irradiation place of an electron beam is displaced in some degree; to prevent a display contrast from being lowered by preventing reflection of outside light; to prevent a fluorescent film from being charged up due to the electron beam and the like. The black conductive material 1010 consist primary of Black lead, however, other materials suited for the above-described object may be used.

In addition, a way for color-coding the fluorescent substances of three primary colors is not limited to arrangement in stripes but a delta arrangement or other arrangement may be available.

Further, in the case of manufacturing the display panel of monochrome, a single fluorescent material may be used for the fluorescent film 1008 and the black lead conductive material is not necessarily used.

In addition, on the surface of the rear plate side of the fluorescent film 1008, the metal back 1009, which has been publicly known in the field of the CRT, is disposed. An object of disposing the metal back 1009 is to improve an optical availability by specular-reflecting a part of a light emitted from the fluorescent film 1008, to protect the fluorescent film 1008 from collision of a negative ion generated together with the electron beam, to allow the fluorescent film 1008 to be operated as an electrode to which an electron beam acceleration voltage is applied, to allow the fluorescent film 1008 to be operated as a conductive path of the electron exiting the fluorescent film 1008 and the like. The metal back 1009 is formed based on a method of smoothing the fluorescent film surface after forming the fluorescent film 1008 on the faceplate substrate 1007, and vacuum-evaporating A1 on the fluorescent film surface. Further, in the case of using a fluorescent substance material for a low voltage for the fluorescent film 1008, the metal back 1009 is not used.

In addition, for example, a transparent electrode made of a transparent electrode ITO or the like may be provided between the faceplate substrate 1007 and the fluorescent film 1008 aiming at application of an acceleration voltage and improvement of a conductivity of a fluorescent film (not used in the present embodiment).

In addition, Dx1 to Dxm, Dy1 to Dyn, and Hv are terminals for electric connection in airtight constitution and the terminals are provided so as to electrically connect the display panel to an electric circuit (not illustrated). The terminals Dx1 to Dxm are electrically connected to the wirings in row direction 1003, the terminals Dy1 to Dyn are electrically connected to the wirings in column direction 1004, and the terminal Hv is electrically connected to the metal back 1009 of the faceplate.

In addition, in order to evacuate the inside the airtight housing, the airtight housing is assembled, an eduction pipe (not illustrated) is connected to a vacuum pump, and hen the inside of the airtight housing is evacuated to a degree of vacuum of $1\times10^{-7}$ [Torr]. Then, the eduction pipe is sealed. In this case, in order to maintain a degree of vacuum in the airtight housing, a getter film (not illustrated) is formed on a predetermined position in the airtight housing just before sealing or after sealing. The getter film is a film formed by heating and evaporating a getter material consist primarily of Ba by means of a heater or a high frequency heating, for example, and the inside of the airtight housing is kept at a degree of vacuum of $1\times10^{-5}$ to $1\times10^{-7}$ [Torr] due to an absorbent action of the getter film.

Further, a step for heating the getter material may be carried out every time when a degree of vacuum is deteriorated after sealed.

While the present invention has been described with reference to exemplary embodiments, it is to be understood that the invention is not limited to the disclosed exemplary embodiments. The scope of the following claims is to be accorded the broadest interpretation so as to encompass all such modifications and corresponding structures and functions.

This application claims the benefit of Japanese Patent Application No. 2006-185524, filed on Jul. 5, 2006, which is hereby incorporated by reference herein in its entirety.

What is claimed is:

1. An image display apparatus comprising:

an electron source;

a light-emitting member for emitting a light by irradiation with electrons emitted from the electron source;

an anode electrode, which is arranged being opposed to the electron source;

a high-voltage generating circuit for generating a potential which rises in a predetermined period;

a wiring for connecting the anode electrode to the high-voltage generating circuit;

a comparator;

a first circuit for applying a first potential satisfying a positive correlation with the potential on the wiring to the comparator; and a second circuit for applying a second potential, which continuously rises or rises in stepwise manner in the predetermined period, to the comparator;

wherein the comparator outputs a result of comparison between the first potential and the second potential.

2. An image display apparatus according to claim 1, wherein the second potential is inputted to the high-voltage generating circuit; and the high-voltage generating circuit outputs a potential obtained by amplifying the inputted second potential.

3. An image display apparatus according to claim 1, further comprising a third circuit for outputting a third potential to be inputted to the high-voltage generating circuit and the second circuit;

wherein the high-voltage generating circuit outputs a potential obtained by amplifying the inputted third potential; and the second potential is a potential which is calculated from the third potential inputted to the second circuit.

4. An image display apparatus according to claim 1, further comprising a control circuit;

wherein the control circuit controls the image display apparatus so as to stop the display in response to the result of comparison between the first potential and the second potential by means of the comparator.

5. An image display apparatus comprising:

an electron source;

a light-emitting member for emitting a light by irradiation with electrons emitted from the electron source;

an anode electrode, which is arranged being opposed to the electron source;

a high-voltage generating circuit for generating a potential which rises in a predetermined period;

a wiring for connecting the anode electrode to the high-voltage generating circuit;

a comparator;

a first circuit for applying a first potential satisfying a negative correlation with the potential on the wiring to the comparator; and a second circuit for applying a second potential, which continuously falls or falls in stepwise manner in the predetermined period, to the comparator;

wherein the comparator outputs a result of comparison between the first potential and the second potential.

6. An image display apparatus according to claim 5, wherein the second potential is inputted to the high-voltage generating circuit; and the high-voltage generating circuit outputs a potential obtained by amplifying the inputted second potential.

7. An image display apparatus according to claim 5, further comprising a third circuit for outputting a third potential to be inputted to the high-voltage generating circuit and the second circuit;

wherein the high-voltage generating circuit outputs a potential obtained by amplifying the inputted third potential; and the second potential is a potential which is calculated from the third potential inputted to the second circuit.

8. An image display apparatus according to claim 5, further comprising a control circuit;

wherein the control circuit controls the image display apparatus so as to stop the display in response to the result of comparison between the first potential and the second potential by means of the comparator.

9. An image display apparatus comprising:

an electron source;

a light-emitting member for emitting a light by irradiation with electrons emitted from the electron source;

an anode electrode, which is arranged being opposed to the electron source;

a high-voltage generating circuit for generating a potential which rises in a predetermined period;

a first wiring for connecting the anode electrode to the high-voltage generating circuit;

a second wiring which is connected to the anode electrode;

a comparator;

a first circuit for applying a first potential satisfying a positive correlation with the potential on the second wiring to the comparator; and a second circuit for applying a second potential, which continuously rises or rises in stepwise manner in the predetermined period, to the comparator;

wherein the comparator outputs a result of comparison between the first potential and the second potential.

10. An image display apparatus according to claim 9, wherein the second potential is inputted to the high-voltage generating circuit; and the high-voltage generating circuit outputs a potential obtained by amplifying the inputted second potential.

11. An image display apparatus according to claim 9, further comprising a third circuit for outputting a third potential to be inputted to the high-voltage generating circuit and the second circuit;

wherein the high-voltage generating circuit outputs a potential obtained by amplifying the inputted third potential; and the second potential is a potential which is calculated from the third potential inputted to the second circuit.

12. An image display apparatus according to claim 9, further comprising a control circuit;

wherein the control circuit controls the image display apparatus so as to stop the display in response to the result of comparison between the first potential and the second potential by means of the comparator.

13. An image display apparatus comprising:

an electron source;

a light-emitting member for emitting a light by irradiation with electrons emitted from the electron source;

an anode electrode, which is arranged being opposed to the electron source;

a high-voltage generating circuit for generating a potential which rises in a predetermined period;

a first wiring for connecting the anode electrode to the high-voltage generating circuit;

a second wiring which is connected to the anode electrode;

a comparator;

a first circuit for applying a first potential satisfying a negative correlation with the potential on the second wiring to the comparator; and a second circuit for applying a second potential, which continuously falls or falls in stepwise manner in the predetermined period, to the comparator;

wherein the comparator outputs a result of comparison between the first potential and the second potential.

14. An image display apparatus according to claim 13, wherein the second potential is inputted to the high-voltage generating circuit; and the high-voltage generating circuit outputs a potential obtained by amplifying the inputted second potential.

15. An image display apparatus according to claim 13, further comprising a third circuit for outputting a third potential to be inputted to the high-voltage generating circuit and the second circuit;

wherein the high-voltage generating circuit outputs a potential obtained by amplifying the inputted third potential; and the second potential is a potential which is calculated from the third potential inputted to the second circuit.

16. An image display apparatus according to claim 13, further comprising a control circuit;

wherein the control circuit controls the image display apparatus so as to stop the display in response to the result of comparison between the first potential and the second potential by means of the comparator.

17. An image display apparatus comprising:

an electron source;

a light-emitting member for emitting a light by irradiation with electrons emitted from the electron source;

an anode electrode, which is arranged being opposed to the electron source;

a high-voltage generating circuit for generating a potential to be applied to the anode electrode; and a circuit for detecting lowering of the potential of the anode electrode in a period when the potential generated by the high-voltage generating circuit rises.

18. An image display apparatus according to claim 17, wherein the circuit for detecting lowering of the potential of the anode electrode includes an analog comparator or a digital comparator.

* * * * *